US008437495B2

(12) United States Patent
Wright et al.

(10) Patent No.: US 8,437,495 B2
(45) Date of Patent: May 7, 2013

(54) TENSIONED ADJUSTMENT MECHANISM FOR MOUNTED LOUDSPEAKER SYSTEM

(75) Inventors: Doug Stuart Wright, Coeur d'Alene, ID (US); Albert Burdett, Pinecrest, FL (US); Lowell J Smith, Rancho Palos Verdes, CA (US); Michael L Strange, Wilton Manors, FL (US)

(73) Assignee: Niles Audio Corporation, Miami, FL (US)

( * ) Notice: Subject to any disclaimer, the term of this patent is extended or adjusted under 35 U.S.C. 154(b) by 399 days.

(21) Appl. No.: 12/882,055

(22) Filed: Sep. 14, 2010

(65) Prior Publication Data

US 2012/0063623 A1 Mar. 15, 2012

(51) Int. Cl.
*H04R 1/02* (2006.01)

(52) U.S. Cl.
USPC ..... 381/395; 381/392; 381/391

(58) Field of Classification Search ..... 381/395, 381/391, 392, 337, 341, 339, 343, 342; 181/152, 181/159, 177, 187, 188, 192, 193
See application file for complete search history.

(56) References Cited

U.S. PATENT DOCUMENTS 4,439,643 A * 3/1984 Schweizer ..... 381/395
4,893,343 A * 1/1990 Bader ..... 381/341
5,804,774 A * 9/1998 Ford et al. ..... 181/152

OTHER PUBLICATIONS

International preliminary report on patentability dated Sep. 28, 2012 issued in corresponding international application PCT/US10/48804.

* cited by examiner

*Primary Examiner* — Curtis Kuntz
*Assistant Examiner* — Amir Etesam
(74) *Attorney, Agent, or Firm* — DLA Piper LLP (US)

(57) ABSTRACT

A compensation assembly for a mounted loudspeaker system includes a mounting frame having a spherical front socket; a retaining ring; a compensating back socket having a spherical back socket; and a woofer frame having a spherical ball structure that fits between the front and back sockets. The compensating back socket has an array of matching slots that align with and partially surround bosses of the mounting frame such that the compensating back socket is free to float in a vertical axis but is restrained from rotating around a central axis. The ball structure is held by a force applied to the compensating back socket by compressing deformable elements around the outer perimeter of the compensating back socket. The deformable elements may be integrally formed as molded-in-place polymer tensioning springs or separately formed as metallic elements.

15 Claims, 11 Drawing Sheets

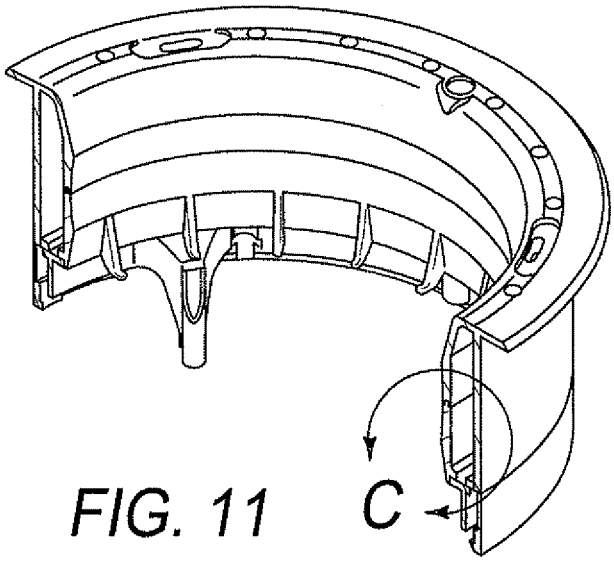
FIG. 11
FIG. 13
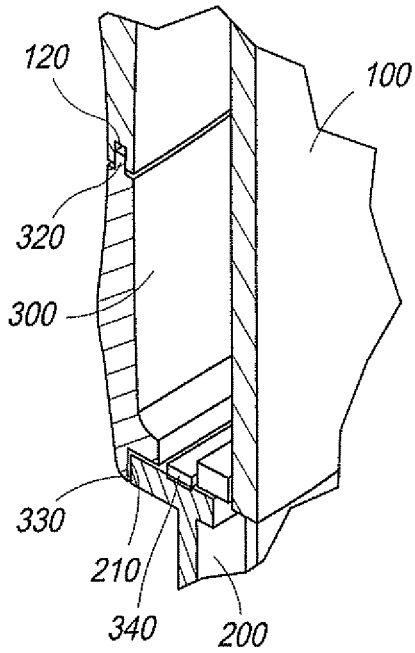
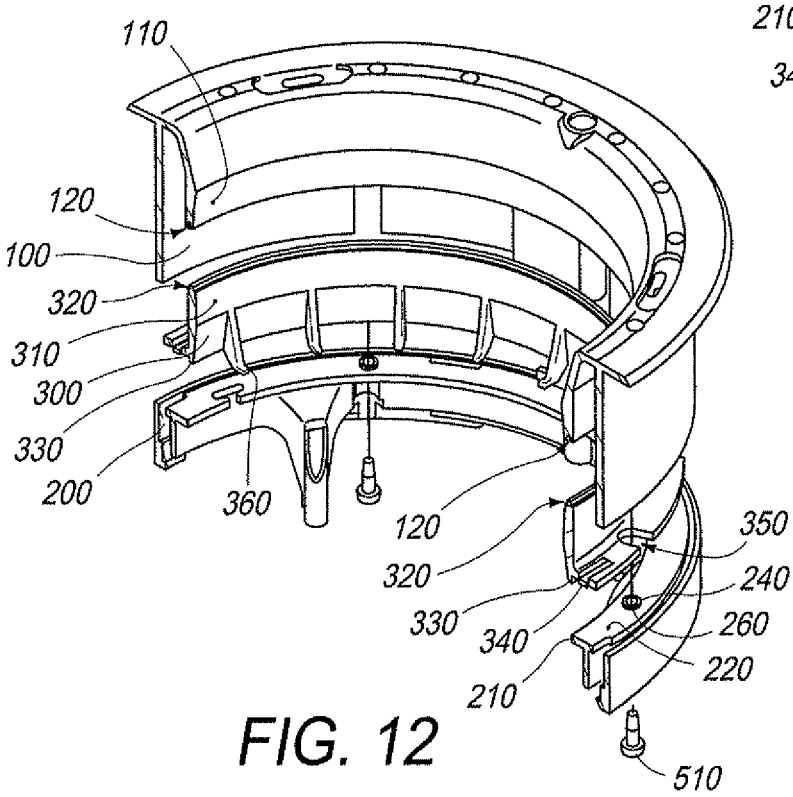
FIG. 12

TENSIONED ADJUSTMENT MECHANISM FOR MOUNTED LOUDSPEAKER SYSTEM

BACKGROUND OF THE INVENTION

1. Field of the Invention

This invention relates to mounted loudspeaker systems, and in particular to a mechanism compensating for dimensional variations associated with a pivoting or rotating woofer.

2. Description of Related Art

In-wall and in-ceiling mounted loudspeakers are a popular method for installing sound reproduction systems into residential and commercial spaces. They require no floor or wall space and their visual footprints are relatively innocuous. However, as a producer of accurately transmitted acoustical information, when compared to its floor or wall mounted counterparts, significant challenges must be overcome to minimize the effects of being mounted in a ceiling structure. Rarely does the installer have the luxury of installing these systems in the best locations for acoustical performance. This is typically due to aesthetic reasons and/or unmodifiable features of architecture. The principal acoustical difficulties presented by ceiling mounted loudspeakers are that the transducers are mounted inside a recessed cavity, and that listening areas are typically substantially off-axis to the transducer's default and ideal direction of propagation. To minimize artifacts caused by these difficulties, it is desirable to be able to rotate or angle the transducers toward the preferred listening area.

For a low/mid frequency transducer, this may be accomplished through use of a ball and socket system consisting of three fundamental components: a front socket that is typically integrated into a primary mounting frame structure; a back socket that is rigidly coupled to the front socket and integrated into a retaining ring structure; and a ball like structure that is either integrated into or carries the woofer assembly. Such a ball and socket system allows a limited degree of rotation or pivoting of the woofer relative to the front/back socket assembly.

A number of limitations and variables are imposed by available and cost viable manufacturing processes. These variables result in large differences in stiction (the force required to cause one body in contact with another to begin to move), and subsequently, the smoothness of movement of the woofer after its stiction is overcome. To the user/installer these variables present as either too loose or too tight, with few being judged "just right". In order to function properly the socket moldings must be perfectly joined, aligned and spherical with adequate stability to maintain their shape. The ball also must be perfectly spherical and stable. Mating surfaces must be hard and smooth enough to allow for minimum stiction and for subsequent predictable motion. The fit between parts must both permit movement and be tight enough to hold the woofer assembly in the desired orientation regardless of any effects caused by vibration of the woofer or environmental factors such as temperature/humidity variations. These environmental and manufacturing factors both individually and collectively act to work against ideal fit and operation. However, even when the components are perfect and properly assembled, there are conditions that can potentially thwart consistent functionality, and reliance on "perfect parts" is folly as the tolerances required fall outside the capability of available manufacturing processes.

SUMMARY OF THE INVENTION

The present invention compensates for variations in roundness and size typically encountered in the molding and manufacturing processes. It provides a tight fit while minimizing variations in stiction, drag and binding/jamming that is found in previous pivoting woofer systems. This is achieved by separating or de-coupling the back socket from the component it is typically integrated into (the retaining ring), resulting in creation of a compensating back socket that floats up and down vertically along the woofer's central axis. The compensating back socket compensates for the aforementioned dimensional variations.

Accordingly, the present invention provides a compensation assembly for a mounted loudspeaker system. In one embodiment, the assembly includes a mounting frame having a spherical front socket; a retaining ring; a compensating back socket having a spherical back socket; and a woofer frame having a spherical ball structure that fits between the front socket of the mounting frame and the back socket of the compensating back socket. In a mounted configuration, the mounting frame is installed within a cavity such that a rim of the mounting frame rests against an exterior surface of the cavity while remaining portions of the mounting frame extend into the cavity. The retaining ring may couple the components of the compensation assembly together via a plurality of threaded fasteners driven into the bosses of the mounting frame.

In one embodiment the compensating back socket has a plurality of fingers that limit the angle of rotation of the woofer frame. The compensating back socket is retained, but not rigidly coupled, between the mounting frame and the retaining ring. The compensating back socket may incorporate an array of matching slots that align with and partially surround the bosses of the mounting frame such that the compensating back socket is free to float in a vertical axis of the assembly but is restrained from rotating around a central axis of the assembly, thereby enabling the relating parts to maintain the appropriate range of tensioning, regardless of minor variations within the individual parts.

In one embodiment, a rib located along a top edge of the compensating back socket loosely mates with a slot incorporated into a bottom edge of the front socket of the mounting frame. The rib and the slot are sized to allow a small amount of vertical movement up and down the vertical axis but little or no lateral movement. In addition, a rib incorporated into the bottom edge of the compensating back socket may capture a flange of the retaining ring, the rib and the flange again being configured to allow a small amount of movement in the vertical axis with little or no lateral movement.

In one embodiment, the ball structure of the woofer frame is slightly compressed between a surface of the front socket of the mounting frame and a surface of the back socket of the compensating back socket. The ball structure is held using a controlled amount of tension placed against the surface of the front socket by a force applied to and through the compensating back socket by compressing a plurality of deformable elements arrayed around the outer perimeter of the compensating back socket. The deformable elements apply a force that retains the woofer frame against a surface of the retaining ring, thereby lifting or pushing the compensating back socket, and compressing the ball structure in a controlled fashion between the front and back sockets. In one embodiment, the deformable elements are integrally formed with the compensating back socket and may take the form of molded-in-place polymer tensioning springs. In another embodiment, the deformable elements are formed as separate metallic elements. The thickness or stiffness of the deformable elements may be varied in order to adjust stiction, freedom of movement and how tightly the woofer frame is retained in position.

These and other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 11 is a partial sectional view of the assembly with the woofer frame removed.

FIG. 12 is a top perspective and expanded view of the assembly with the woofer frame removed.

FIG. 13 is an enlarged view of area "C" of FIG. 11.

DETAILED DESCRIPTION OF THE INVENTION

Figure 1:
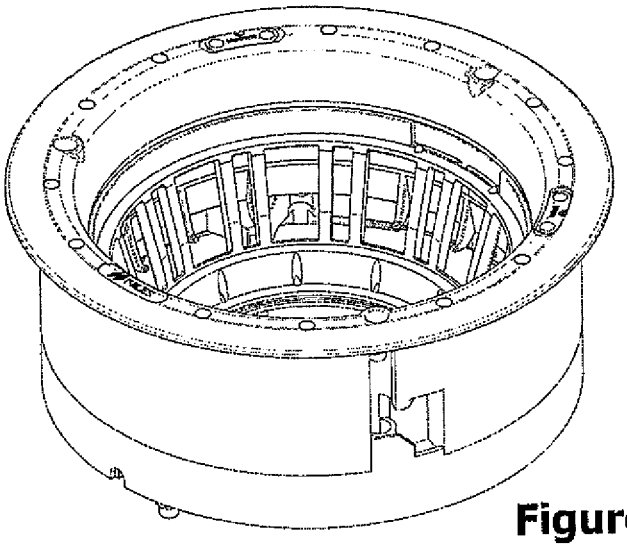
FIG. 1 is a top perspective view of a compensation assembly for a mounted loudspeaker system according to the invention.
Figure 2:
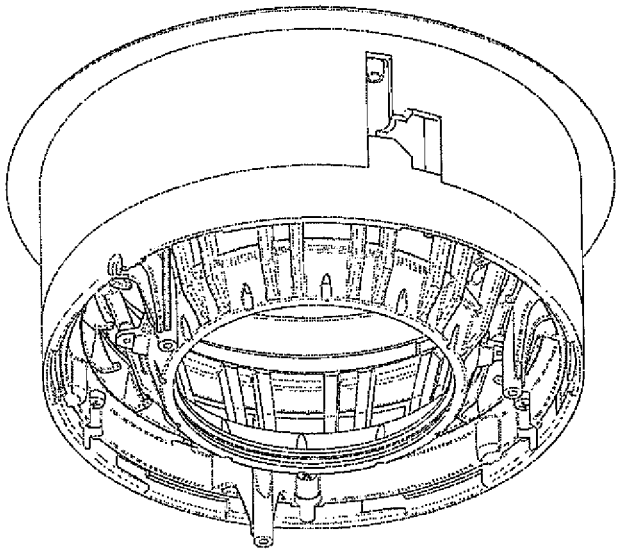
FIG. 2 is a bottom perspective view of the assembly.
Figure 3:
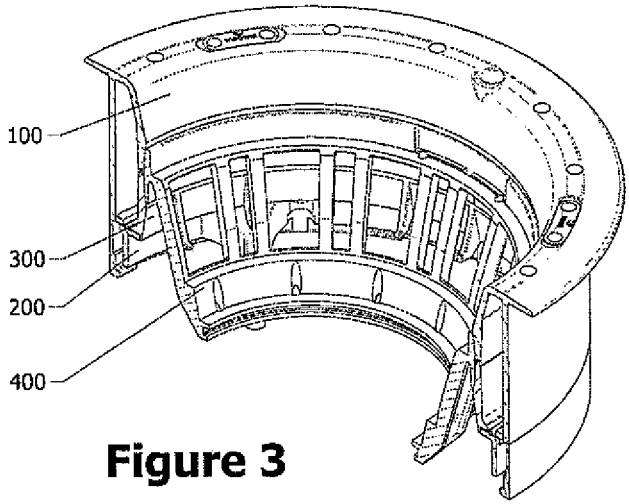
FIG. 3 is a partially cut-away top perspective view of the assembly.
Figure 4:
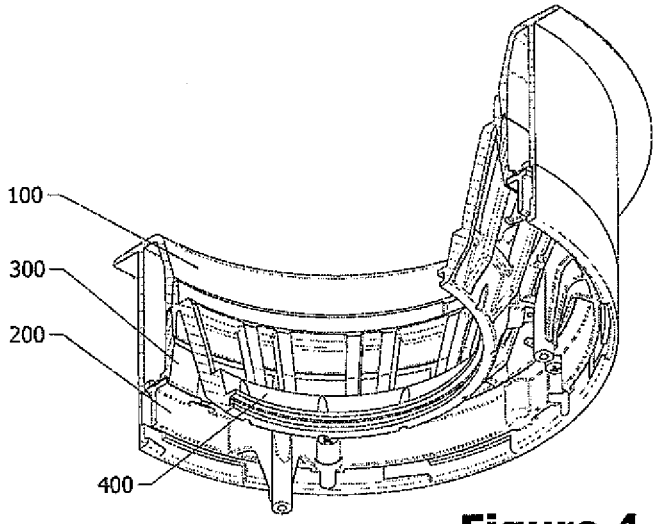
FIG. 4 is a partially cut-away bottom perspective view of the assembly.
Figure 5:
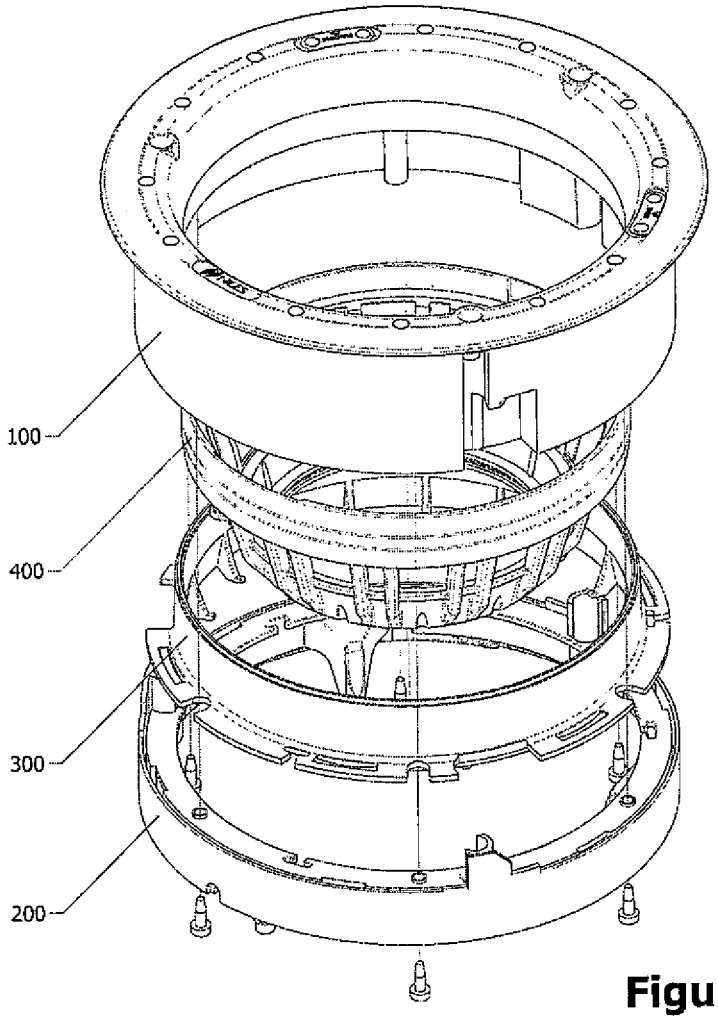
FIG. 5 is a top perspective and expanded view showing components of the assembly.
Figure 6:
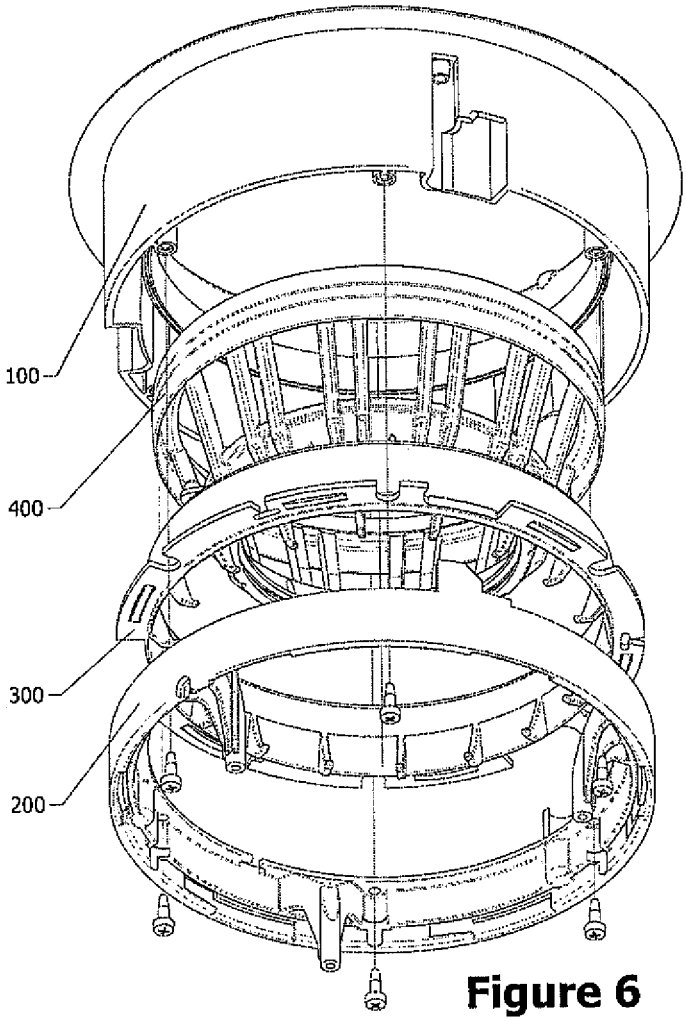
FIG. 6 is a bottom perspective and expanded view showing components of the assembly.
Figure 7:
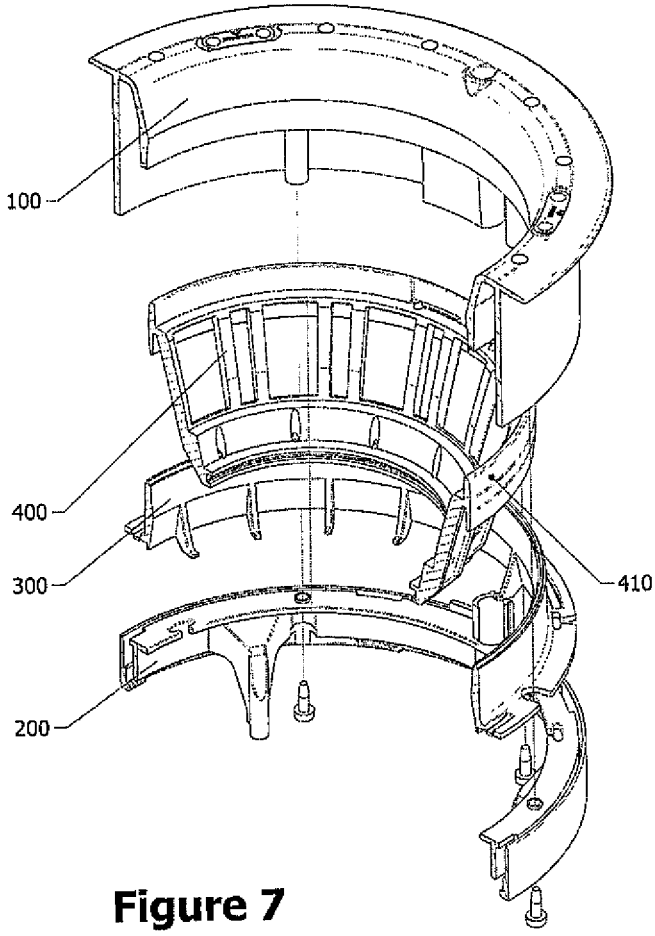
FIG. 7 is a partially cut-away top perspective and expanded view showing components of the assembly.
Figure 8:
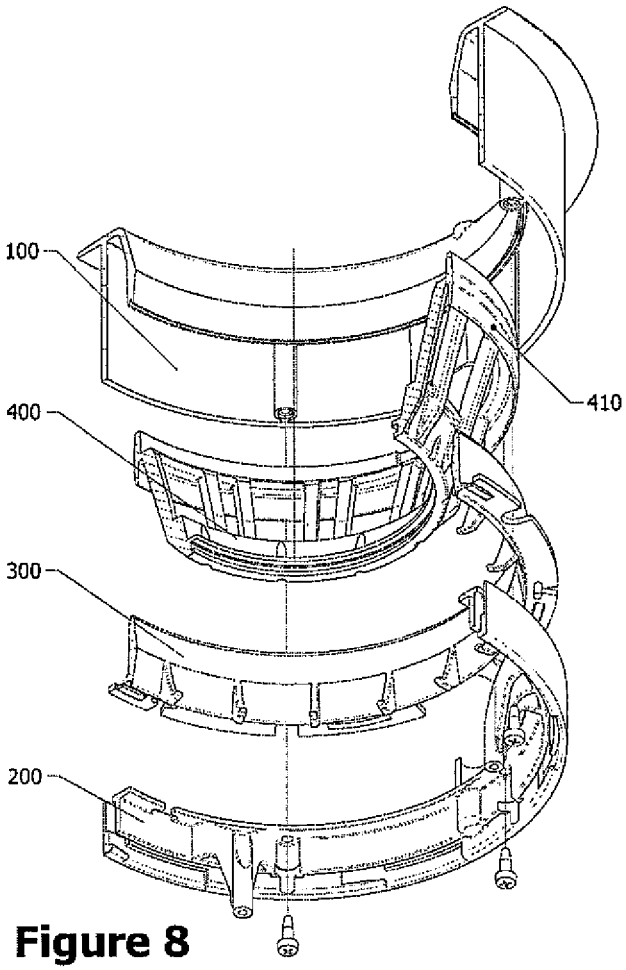
FIG. 8 is a partially cut-away bottom perspective and expanded view showing components of the assembly.
Figure 9:
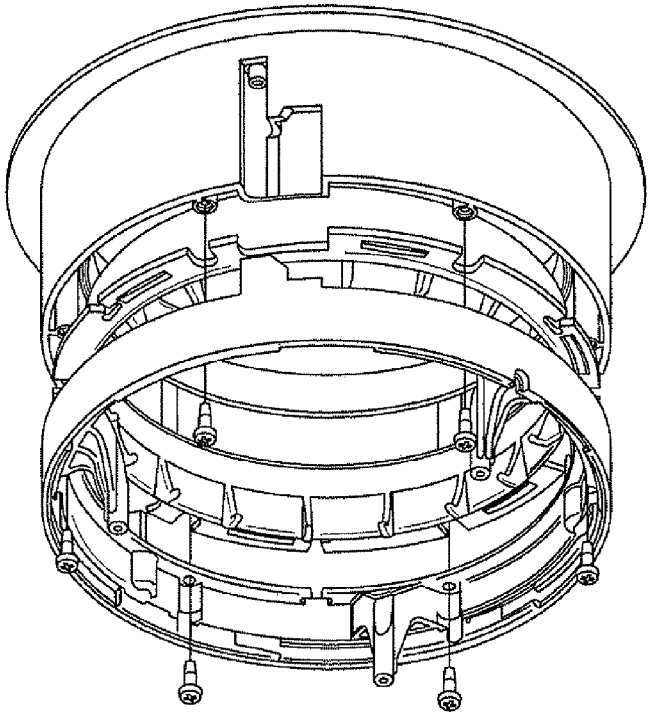
FIG. 9 is a bottom perspective and expanded view of the assembly with the woofer frame removed.
Figure 10:
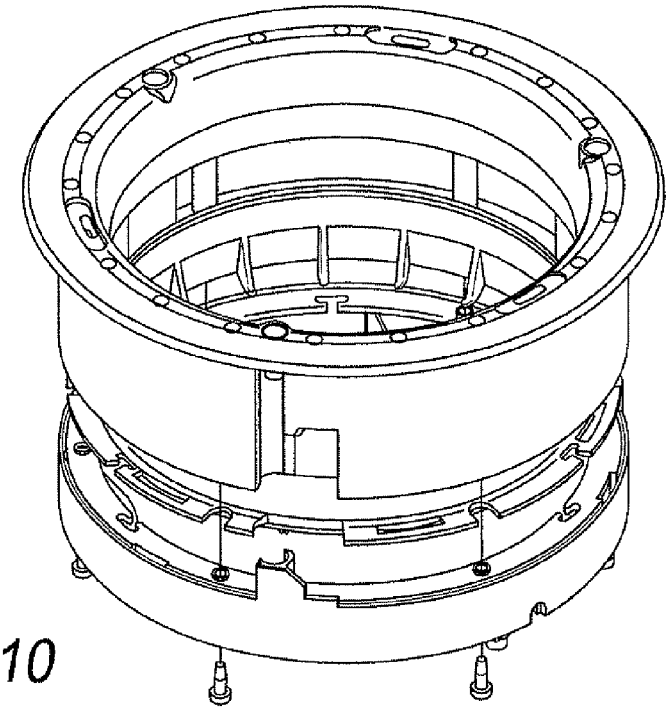
FIG. 10 is a top perspective and expanded view of the assembly with the woofer frame removed.
Figure 14:
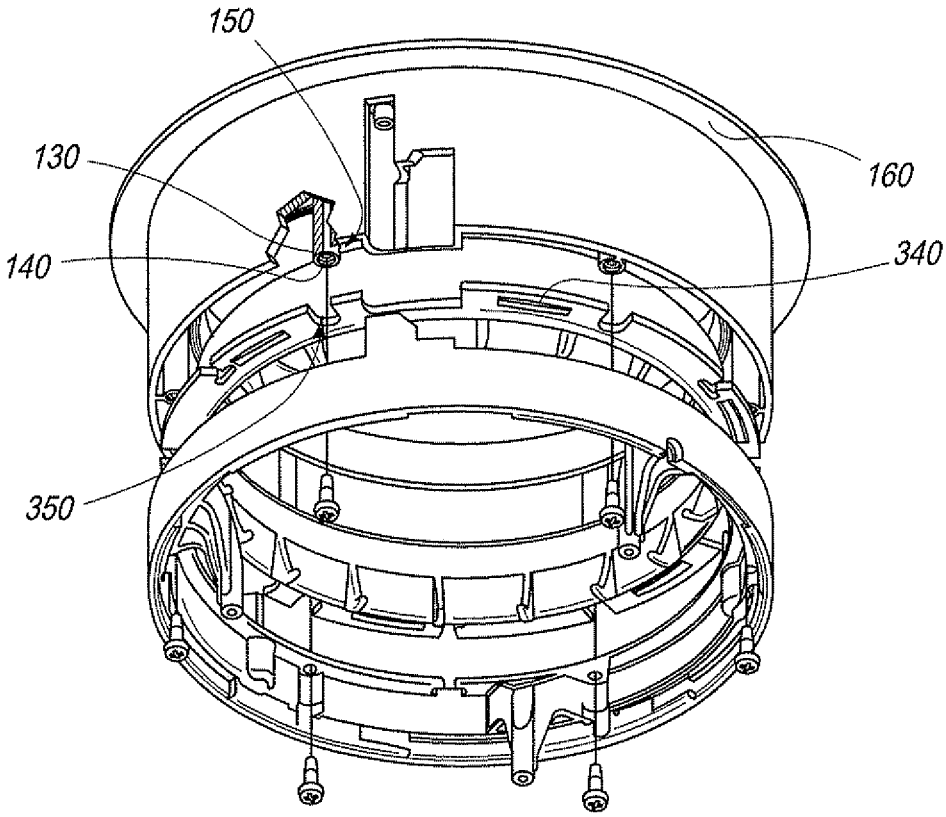
FIG. 14 is a bottom perspective and expanded view of the assembly with a cutaway that illustrates a mounting frame fastener mounting boss according to the invention.
Figure 15:
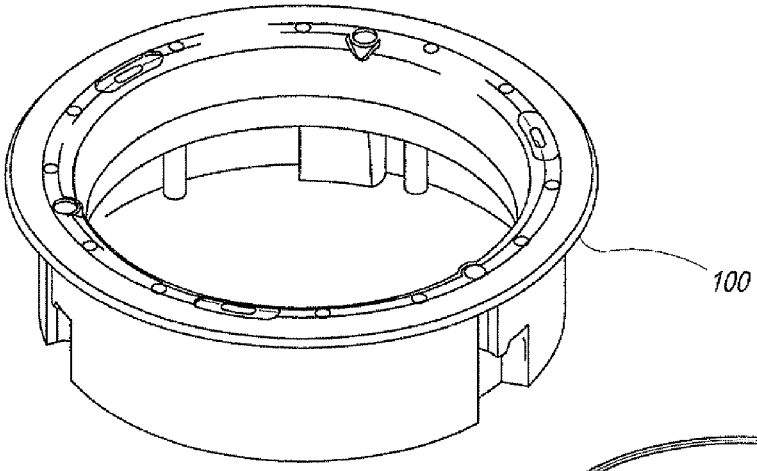
FIG. 15 is a perspective view of a mounting frame according to the invention.
Figure 16:
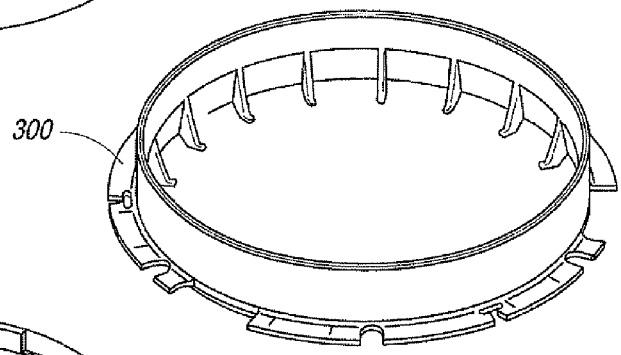
FIG. 16 is a perspective view of a compensating back socket according to the invention.
Figure 17:
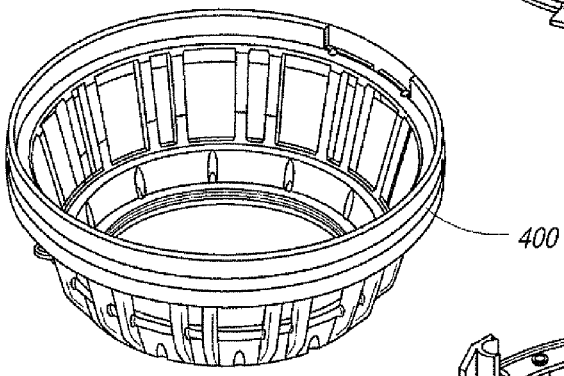
FIG. 17 is a perspective view of the woofer frame according to the invention.
Figure 18:
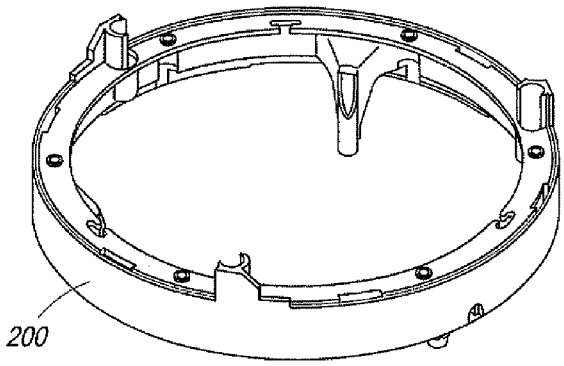
FIG. 18 is a perspective view of a retaining ring according to the invention.
Figure 19:
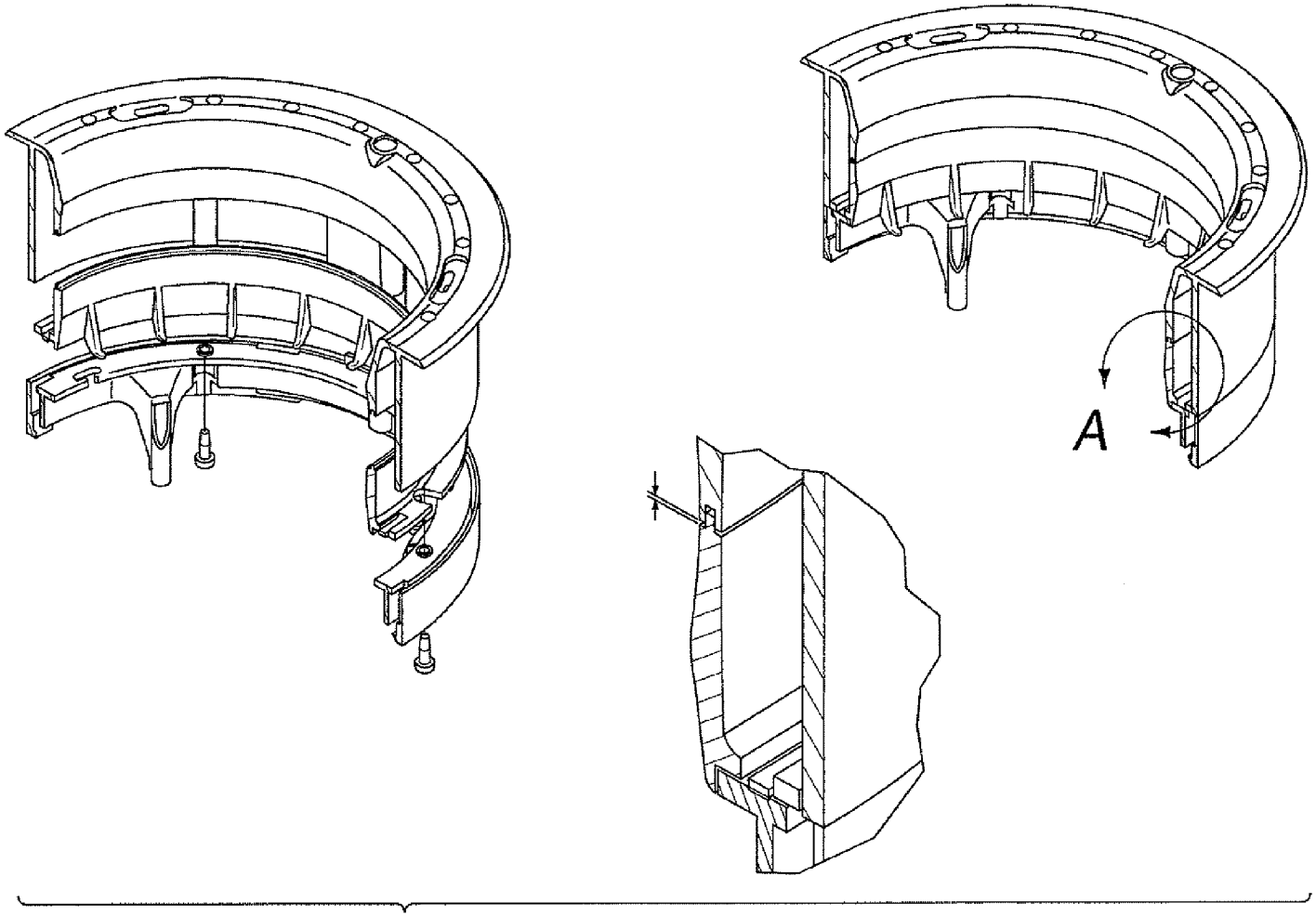
FIG. 19 is a summary illustration depicting and describing features of the invention.

FIGS. 1-19 illustrate major components of a compensation assembly for a mounted loudspeaker system according to the invention, including mounting frame or baffle 100, retaining ring 200, compensating back socket 300 and woofer frame 400. The loudspeaker system may be mounted, for example, in-ceiling, in-wall, or in any other structure. Mounting frame 100 is configured to be installed within a cavity such that rim 160 rests against an exterior surface of the cavity while the remaining portions of mounting frame 100 extend into the cavity. Mounting frame 100 also includes front socket 110 defining a spherical surface and a plurality of bosses 150 serving as attachment points for retaining ring 200.

Retaining ring 200 couples the components of the assembly together via a plurality of threaded fasteners 510 driven into bosses 150 of mounting frame 100. Compensating back socket 300 has a back socket 310 defining a spherical surface and a plurality of fingers 360 that limit the angle of rotation of woofer frame 400. Compensating back socket 300 is retained, but not rigidly coupled, between mounting frame 100 and retaining ring 200. Woofer frame 400 carries functional components as typical and known in the art for a low/mid frequency producing transducer. In addition it has a spherical ball structure 410 that fits between front socket 110 of mounting frame 100 and back socket 310 of compensating back socket 300.

In this manner, the socket structure for encompassment of ball 410 of woofer frame 410 is split into two halves 110 and 310. In addition to facilitating manufacturability, splitting the socket into halves also presents the opportunity of arranging one of the socket halves to mechanically "float" slightly such that it can compensate for variations in the shape, size and position of various ball/socket structures.

Mounting frame 100 is coupled to retaining ring 200 by a plurality of threaded fasteners 510 that are fed through corresponding holes 240 and matingly coupled to corresponding bosses 150. Mounting boss end 130 of frame 100 has a recessed cavity 140 that inserts into raised annular rib 260 that surrounds hole 240. Mounting frame 100 is securely coupled to retaining ring 200 with mounting frame mounting boss end 130 being pulled tight against retaining ring surface 220 by fasteners 510. The combined structure thereby transfers mass bearing loads imposed by various auxiliary components to flange 160 of mounting frame 100 without imposing spurious multi-directional loads onto or through compensating back socket 300. These forces, if placed on compensating back socket 300, would have a negative impact on the ability of compensating back socket 300 to apply equal pressure on ball structure 410 of woofer frame 400.

Compensating back socket 300 incorporates an array of matching slots 350 that align with and partially surround bosses 150 such that compensating back socket 300 remains free to float in the vertical axis of the assembly but is restrained from rotating around the central axis of the assembly.

FIGS. 11 and 13 illustrate two features provided along the top and bottom extremities of compensating back socket 300 to stabilize compensating back socket 300 in the vertical axis. The first feature, rib 320, is located along the top edge of compensating back socket 300 and is configured to loosely mate with slot 120, which is incorporated into the bottom edge of front socket 110 of mounting frame 100. Rib 320 and slot 120 are sized to allow a small amount of vertical movement up and down the vertical axis but little or no lateral movement. The second feature, rib 330, is incorporated into the bottom edge of compensating back socket 300 so as to capture flange 210 of retaining ring 200. Rib 330 and flange 210 are also configured to allow a small amount of movement in the vertical axis with little or no lateral movement. The overall height of compensating back socket 300 is also set to allow a small amount of vertical movement along the vertical axis while allowing for little or no lateral movement.

Upon assembly, ball structure 410 of woofer frame 400 is slightly "compressed" between the surface of front socket 110 of mounting frame 100 and the surface of back socket 310 of compensating back socket 300. Ball 410 is held using a controlled amount of tension placed against the surface of front socket 110 by a force applied to and through compensating back socket 300 that is created by compressing a plurality of deformable elements 340 arrayed around the outer perimeter of compensating back socket 300. Deformable elements 340 may be integrally formed as a feature of compensating back socket 300 or as separate metallic elements. The functional objective of the deformable elements 340 is the application of a force that is adequate to retain woofer 400 against surface 220 of retaining ring 200, thereby "lifting" or "pushing" compensating back socket 300 as a whole, and compressing ball 410 in a controlled way between the two socket halves.

Deformable elements 340 are preferably integrated into compensating back socket 300 in order to reduce the number of parts and provide a less complex assembly. For example, deformable elements 340 may take the form of a molded-in-place polymer tensioning "spring", but is not limited to this form. However, use of separate metallic elements as deformable elements 340 also serves to achieve the desired objectives. Stiction, the subsequent freedom of movement and how tightly the woofer assembly is retained in position can be adjusted by varying the thickness and/or stiffness of deformable elements 340.

The particular embodiments of the invention described in this document are illustrative and not restrictive. Modification may be made without departing from the spirit and scope of the invention as defined by the following claims.

The invention claimed is:

1. A compensation assembly for a mounted loudspeaker system comprising:

a mounting frame having a spherical front socket; a compensating back socket having a spherical back socket; a woofer frame having a spherical ball structure that fits between the front socket of the mounting frame and the back socket of the compensating back socket; and a retaining ring, wherein the ball structure of the woofer frame is slightly compressed between a surface of the front socket of the mounting frame and a surface of the back socket of the compensating back socket, and the ball structure is held using a controlled amount of tension placed against the surface of the front socket by a force applied to and through the compensating back socket by compressing a plurality of deformable elements arrayed around the outer perimeter of the compensating back socket, wherein the deformable elements apply a force that retains the woofer frame against a surface of the retaining ring, thereby lifting or pushing the compensating back socket, and compressing the bait structure in a controlled fashion between the front and back sockets.

2. A compensation assembly as claimed in claim 1, wherein the mounting frame is installed within a cavity such that a rim of the mounting frame rests against an exterior surface of the cavity while remaining portions of the mounting frame extend into the cavity.

3. A compensation assembly as claimed in claim 1, wherein the mounting frame comprises a plurality of bosses serving as attachment points for the retaining ring.

4. A compensation assembly as claimed in claim 3, wherein the retaining ring couples the components of the compensation assembly together via a plurality of threaded fasteners driven into the bosses of the mounting frame.

5. A compensation assembly as claimed in claim 1, wherein the compensating back socket comprises a plurality of fingers that limit the angle of rotation of the woofer frame.

6. A compensation assembly as claimed in claim 1, wherein the compensating back socket is retained, but not rigidly coupled, between the mounting frame and the retaining ring.

7. A compensation assembly as claimed in claim 3, wherein the compensating back socket incorporates an array of matching slots that align with and partially surround the bosses of the mounting frame such that the compensating back socket is free to float in a vertical axis of the assembly but is restrained from rotating around a central axis of the assembly.

8. A compensation assembly as claimed in claim 1, wherein a rib located along a top edge of the compensating back socket loosely mates with a slot incorporated into a bottom edge of the front socket of the mounting frame.

9. A compensation assembly as claimed in claim 8, wherein the rib and the slot are sized to allow a small amount of vertical movement up and down the vertical axis but little or no lateral movement.

10. A compensation assembly as claimed in claim 1, wherein a rib incorporated into the bottom edge of the compensating back socket captures a flange of the retaining ring.

11. A compensation assembly as claimed in claim 10, wherein the rib and the flange are configured to allow a small amount of movement in the vertical axis with little or no lateral movement.

12. A compensation assembly as claimed in claim 1, wherein the deformable elements are integrally formed with the compensating back socket.

13. A compensation assembly as claimed in claim 12, wherein the deformable elements comprise a molded-in-place polymer tensioning spring.

14. A compensation assembly as claimed in claim 1, wherein the deformable elements are formed as separate metallic elements.

15. A compensation assembly as claimed in claim 1, wherein the thickness or stiffness of the deformable elements is varied in order to adjust stiction, freedom of movement and how tightly the woofer frame is retained in position.

* * * * *